US009085071B2

(12) United States Patent
Larouche

(10) Patent No.: US 9,085,071 B2
(45) Date of Patent: Jul. 21, 2015

(54) PIN EXTRACTION TOOL

(76) Inventor: Laurier Larouche, Montreal (CA)

( * ) Notice: Subject to any disclaimer, the term of this patent is extended or adjusted under 35 U.S.C. 154(b) by 979 days.

(21) Appl. No.: 13/137,823

(22) Filed: Sep. 15, 2011

(65) Prior Publication Data

US 2012/0066878 A1 Mar. 22, 2012

(30) Foreign Application Priority Data

Sep. 16, 2010 (GB) ..... 1015444.1

(51) Int. Cl.
*B25B 27/02* (2006.01)
*B25B 27/04* (2006.01)
*B25C 11/02* (2006.01)

(52) U.S. Cl.
CPC ..... *B25B 27/023* (2013.01); *B25B 27/04* (2013.01); *B25C 11/02* (2013.01); *Y10T 29/5387* (2015.01)

(58) Field of Classification Search
USPC ..... 29/261
See application file for complete search history.

(56) References Cited

U.S. PATENT DOCUMENTS 1,452,545 A * 4/1923 Bradley ..... 254/22
1,519,067 A * 12/1924 Smith ..... 29/256
2,570,914 A * 10/1951 Buck ..... 254/18
2,709,570 A * 5/1955 Henry ..... 254/18
3,978,576 A * 9/1976 Mustoe, Jr. ..... 254/18
4,007,535 A * 2/1977 Brandt et al. ..... 29/261
4,007,913 A * 2/1977 Aldrich ..... 254/18
4,059,883 A * 11/1977 Osborne ..... 29/259
5,072,982 A * 12/1991 Boss ..... 294/103.1
5,075,948 A * 12/1991 Maier ..... 29/264
5,148,590 A * 9/1992 Wu ..... 29/257
5,213,311 A * 5/1993 Sabo ..... 254/24
5,251,368 A * 10/1993 Somerville et al. ..... 29/255
5,261,149 A * 11/1993 Sutton ..... 29/261
5,479,688 A * 1/1996 Rubino et al. ..... 29/259
5,604,967 A * 2/1997 McMahon ..... 29/263
6,481,691 B1 * 11/2002 Irving ..... 254/28
6,673,078 B1 * 1/2004 Muncie ..... 606/104
6,755,392 B1 * 6/2004 Phillips ..... 254/18
6,877,401 B1 * 4/2005 Giltner ..... 81/53.2
6,910,252 B2 * 6/2005 Draggie et al. ..... 29/263
7,658,368 B2 * 2/2010 Laun ..... 254/18
7,698,794 B2 * 4/2010 Cobzaru ..... 29/256

(Continued)

FOREIGN PATENT DOCUMENTS

DE 19803732 A1 * 8/1999 ..... B25B 27/06
FR 2717114 A1 * 9/1995 ..... B25B 27/08

(Continued)

*Primary Examiner* — Lee D Wilson
*Assistant Examiner* — Alvin Grant

(57) ABSTRACT

A tool for extracting a pin inserted in a component bore extending into a pin receiving component, the tool comprising: a pin gripping element configurable between a released configuration in which the pin and the pin gripping element are movable relative to each other and a gripping configuration in which the pin gripping element grips the pin; a base element for abutting against the pin receiving component; and a gripping element mount mounting the pin gripping element to the base element, the gripping element mount being configurable between a first configuration and a second configuration, wherein, in the first configuration, the pin gripping element is substantially adjacent to the base element, and in the second configuration, the pin gripping element is further away from the base element than in the first configuration. An actuator selectively moves the gripping element mount between the first and second configurations.

25 Claims, 6 Drawing Sheets

(56) References Cited

U.S. PATENT DOCUMENTS

| | | | | |
|---|---|---|---|---|
| 2003/0140473 | A1 * | 7/2003 | Marantette | 29/267 |
| 2005/0229373 | A1 * | 10/2005 | Hu et al. | 29/261 |

FOREIGN PATENT DOCUMENTS

| | | | | |
|---|---|---|---|---|
| FR | 2901166 | A1 * | 11/2007 | B25B 27/02 |
| WO | WO 2008122491 | A1 * | 10/2008 | |

* cited by examiner

Fig. 2
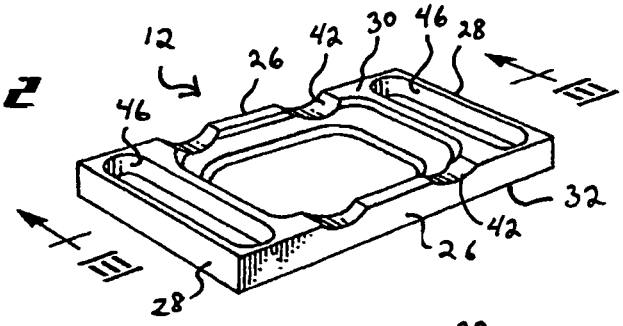
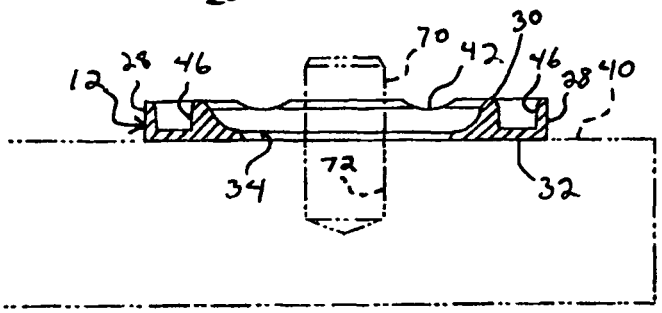
Fig. 3
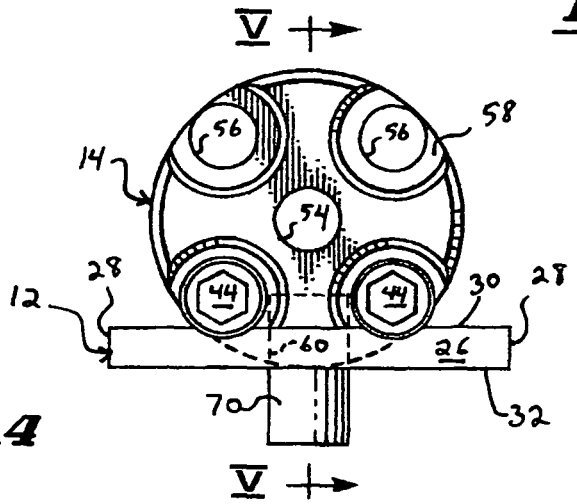
Fig. 4

PIN EXTRACTION TOOL

The present application claims priority from UK Request Application Serial Number 1015444.1 filed on Sep. 16, 2010, the contents of which is hereby incorporated by reference in its entirety.

FIELD OF THE INVENTION

The present invention relates generally to mechanical extraction tools and, more particularly, to an extraction tool used for extracting headless pins, such as dowel pins, press mounted in blind holes provided through the mounting surface of tooling plates, injection mold elements, and the likes.

BACKGROUND

Dowel pin extraction tools are known in the art and are useful for extracting headless pins that are press mounted in blind holes provided through the mounting surface of tooling plates on drilling machines, milling machines, Computed Numerical Control (or CNC) machine tools, multi-part injection molds, and the likes.

Some examples of the prior art are U.S. Pat. Application No. US2003/0140473, to Martantette (published in July 2003), U.S. Pat. No. 5,604,967, to McMahon (issued In February 1997), U.S. Pat. No. 5,193,260, to Pierce (issued in March 1993), U.S. Pat. No. 5,075,948, to Maier (issued in December 1991), U.S. Pat. No. 4,263,705, to Devening (issued in April 1981), and U.S. Pat. No. 3,750,500, to Peterson (issued in August 1973).

While these prior art devices offer an extraction tool that can extract dowel pins from mounting plates and injection molds, they also entail one or more of the following disadvantages:

a) they are generally designed for extracting dowel pins having a specific diameter size;

b) for other implementations of an extraction tool of the prior art that are adapted to extract dowel pins having different diameter sizes, a set of modular parts for the tool must be kept close at hand and exchanged when required;

c) still other implementations of an extraction tool adapted to extract dowel pins having differently sized diameters, are generally provided with a pair of adjustable gripping jaws, much like the gripping jaws on a pair of pliers or a vise, which often damage the cylindrical surface of the dowel pin and/or the adjacent planar surface of the mounting plate;

d) the extraction tools of the prior art that are provided with a means for pushing against the mounting plate, in order to pull the dowel pin out of a blind hole, have their gripping or clamping means axially constrained relative to the pushing means, which creates oblique forces between the extraction tool, the dowel pin and the mounting plate which, in turn, is often a cause of damage to the dowel pin and/or the mounting plate.

Against this background, there exist a need for an improved pin extraction tool. An object of this invention is to provide such a pin extraction tool.

SUMMARY OF THE INVENTION

In a broad aspect, the invention provides a tool for extracting a pin inserted in a component bore, the component bore extending into a pin receiving component, the tool comprising: a pin gripping element, the pin gripping element being configurable between a released configuration in which the pin and the pin gripping element are movable relative to each other and a gripping configuration in which the pin gripping element grips the pin so that the pin and the pin gripping element are attached to each other; a base element for abutting against the pin receiving component when the pin gripping element grips the pin with the pin inserted in the component bore; and a gripping element mount mounting the pin gripping element to the base element, the gripping element mount being configurable between a first configuration and a second configuration, wherein, in the first configuration, the pin gripping element is substantially adjacent to the base element, and in the second configuration, the pin gripping element is further away from the base element than in the first configuration. The gripping element mount includes an actuator for selectively moving the gripping element mount between the first and second configurations.

In some embodiments of the invention, the pin gripping element includes a pin gripping hollow for receiving the pin, the pin gripping hollow being configurable between an expanded configuration and a retracted configuration, the pin gripping hollow being in the expanded configuration when the pin gripping element is in the released configuration and the pin gripping hollow being in the retracted configuration when the pin gripping element is in the gripping configuration.

Typically, the pin gripping element includes at least two pin gripping hollows each configurable between an expanded configuration and a retracted configuration, the pin gripping hollows being in the expanded configuration when the pin gripping element is in the released configuration and the pin gripping hollows being in the retracted configuration when the pin gripping element is in the gripping configuration, the pin gripping hollows having different diameters.

In some embodiments of the invention, the pin gripping element includes a pair of substantially parallel and spaced apart deformable elements and a linking element extending therebetween, the deformable elements defining a pin receiving section for receiving the pin between the deformable elements, the pin gripping element also including a deforming element operatively coupled to the deformable elements for selectively deforming the deformable elements to move the pin gripping element between the released and gripping configurations.

In a variant, the deformable elements are substantially planar and substantially disc-shaped and define a gap therebetween and the linking element is substantially radially centrally located with respect to the deformable elements. The pin receiving section includes a pin gripping hollow extending substantially radially inwardly in the pin gripping element and defined by the deformable elements. Typically, in this variant, the deforming element is operatively coupled to the deformable elements to selectively narrow the gap at the periphery of the deformable elements to vary a diameter of the pin gripping hollow.

In a variant, with the pin gripping element gripping the pin partially inserted in the component bore, the gripping element mount exerts a pulling force on the pin that is substantially longitudinally oriented with respect to the pin when the gripping element mount is moved from the first configuration to the second configuration.

In a variant, the gripping element mount includes a first mount component mechanically coupled to the base element and a second mount component mechanically coupled to the pin gripping element, the first and second mount components being movable with respect to each other, the actuator being operatively coupled to the first and second mount components for moving the first and second mount components with respect to each other to move the gripping element mount between the first and second configurations.

For example, the first mount component extends from the base element and straddles the pin gripping element; and the second mount component straddles the first mount component and the pin gripping element.

In a specific embodiment of the invention, the first and second mount components are both substantially U-shaped and opening toward the base element. For example the first mount component defines a pair of substantially parallel and spaced apart first mount legs interconnected by a first mount base, the second mount component defines a pair of substantially parallel and spaced apart second mount legs interconnected by a second mount base, and the first and second mount bases are substantially perpendicular to each other.

In some embodiments of the invention, the pin gripping element is supported between the second mount legs by an axle extending between the second mount legs in a substantially parallel and spaced apart relationship relative to the second mount base. For example, the pin gripping element is rotatable about the axle.

In some embodiments of the invention, the actuator includes a threaded rod threaded through the second mount base and abutting against the first mount base. Also, in some embodiments of the invention, the actuator includes a handle for selectively rotating the threaded rod to longitudinally move the threaded rod with respect to the second mount base.

In some embodiments of the invention, the second mount component and the pin gripping element are together substantially freely pivotally movable relative to the first mount component.

In some embodiments of the invention, in the pin gripping configuration, the pin gripping element grips the pin with a predetermined gripping force.

In some embodiments of the invention, the base element defines a base aperture extending therethrough for allowing access to the pin when the base element abuts against the pin receiving component in register with the component bore.

In some embodiments of the invention, the pin gripping element, the base element, the gripping element mount and the actuator are detachable from each other.

In a variant, a releaser base is provided for freeing the pin from the pin gripping element when the pin has been extracted from the pin receiving component, said releaser base including a base bore for receiving said pin.

Advantageously, in some embodiments of the invention, the freely rotatable pin gripping element remains at maximum alignment with the longitudinal axis of the pin during an extraction operation, which reduces or eliminates oblique forces between the components of the tool, the pin and the pin receiving component which, in turn, avoids causing damage to the latters.

The various components of the tool described above are manufacturable at relatively low costs. Also, the proposed tool is usable using a sequence of quick and ergonomic steps.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

FIG. 2, in a perspective view, illustrates a base element part of the tool shown in FIG. 1;

FIG. 3, in a cross-sectional view taken along section line III-III of FIG. 2, illustrates the base element shown in FIG. 2;

FIG. 4, in a side elevational view, illustrates a pin gripping element part of the tool shown in FIG. 1, here shown having a peripheral portion thereof engaging in a correspondingly shaped aperture provided through the base element of FIG. 2;

DETAILED DESCRIPTION

Figure 1:
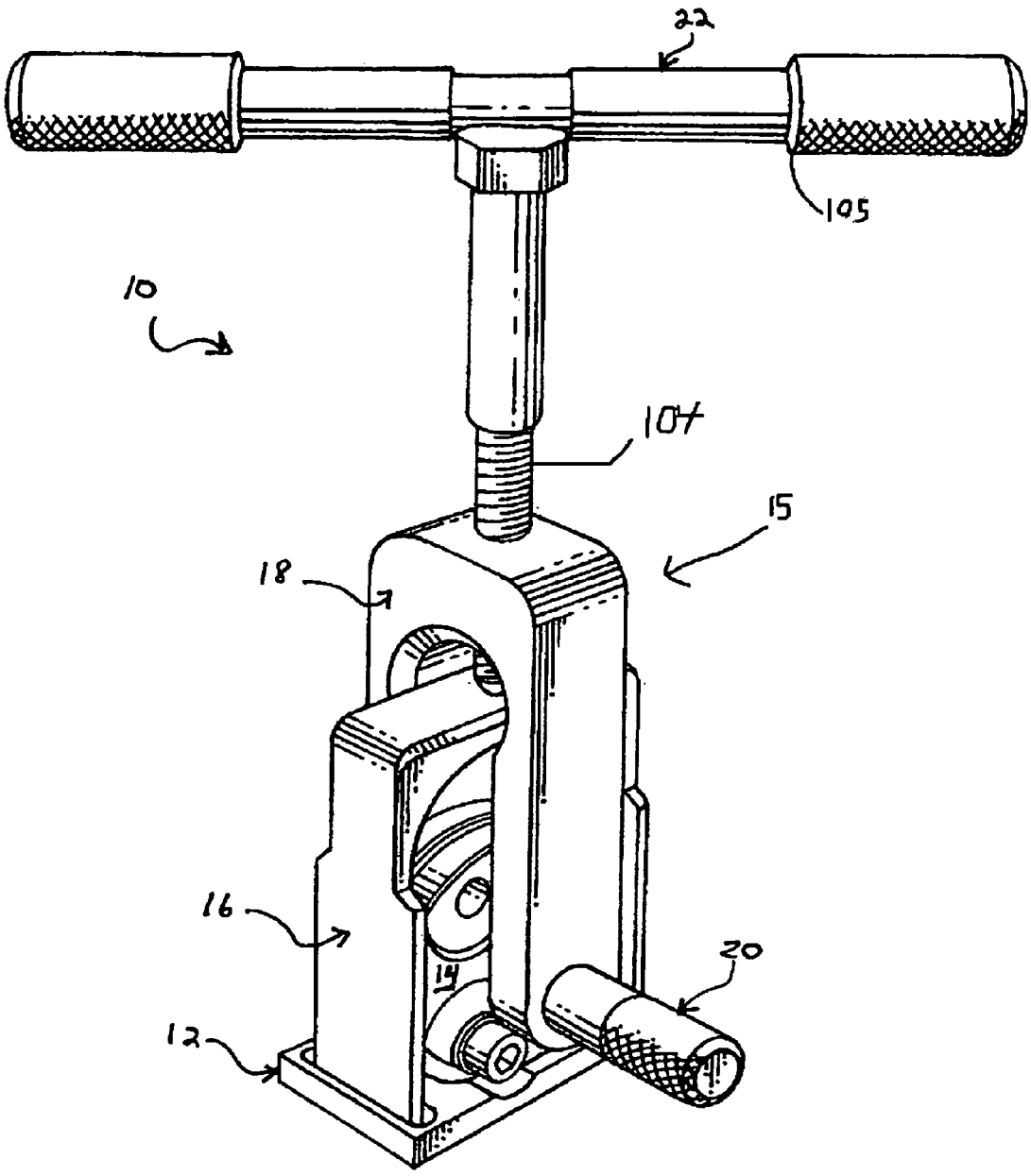
FIG. 1, in a perspective view, illustrates a pin extraction tool in accordance with an embodiment to the present invention.

Referring to FIG. 1, there is shown various aspects of a tool 10 according to an embodiment the present invention. The tool 10 is usable for extracting a pin 70 (shown for example in FIG. 3) inserted in a component bore 72 (shown also for example in FIG. 3), the component bore 72 extending into a pin receiving component 40 (shown also for example in FIG. 3). For example, the pin 70 is a headless pin presenting a substantially smooth surface, such as a dowel pin, press mounted in a component bore 72 taking the form of a blind hole provided through the mounting surface of a pin receiving component 40 in the form of a tooling plate or an injection mold element. However, the tool 10 is usable for other types of pins 70 without detracting from the present invention.

Referring to FIG. 1, the tool 10 includes a base element 12, a pin gripping element 14, and a gripping element mount 15. The gripping element mount 15 mounts the pin gripping element 14 to the base element 12. In some embodiments of the invention, the tool 10 further includes a releaser base 24, illustrated in FIGS. 9 and 10, which may be used for freeing the pin 70 from the pin gripping element after the pin 70 has been extracted from the pin receiving component 40. Typically, but not exclusively, the pin gripping element 14, the base element 12, and the gripping element mount 15 are detachable from each other, which allows compact and easy storage of the tool 10, as well as replacement of parts from the tool 10, for example to replace damaged parts or to allow different uses of the tool 10.

The pin gripping element 14 is configurable between a released configuration in which the pin 70 and the pin gripping element 14 are movable relative to each other and a gripping configuration in which the pin gripping element 14 grips the pin 70 so that the pin 70 and the pin gripping element 14 are attached to each other. In some embodiments of the invention, the configuration of the pin gripping element 14 ensures that in the pin gripping configuration, the pin gripping element 14 grips the pin 70 with a predetermined gripping force.

The base element 12 is provided for abutting against the pin receiving component 40 when the pin gripping element 14 grips the pin 70 with the pin 70 inserted in the component bore 72.

Figure 7:
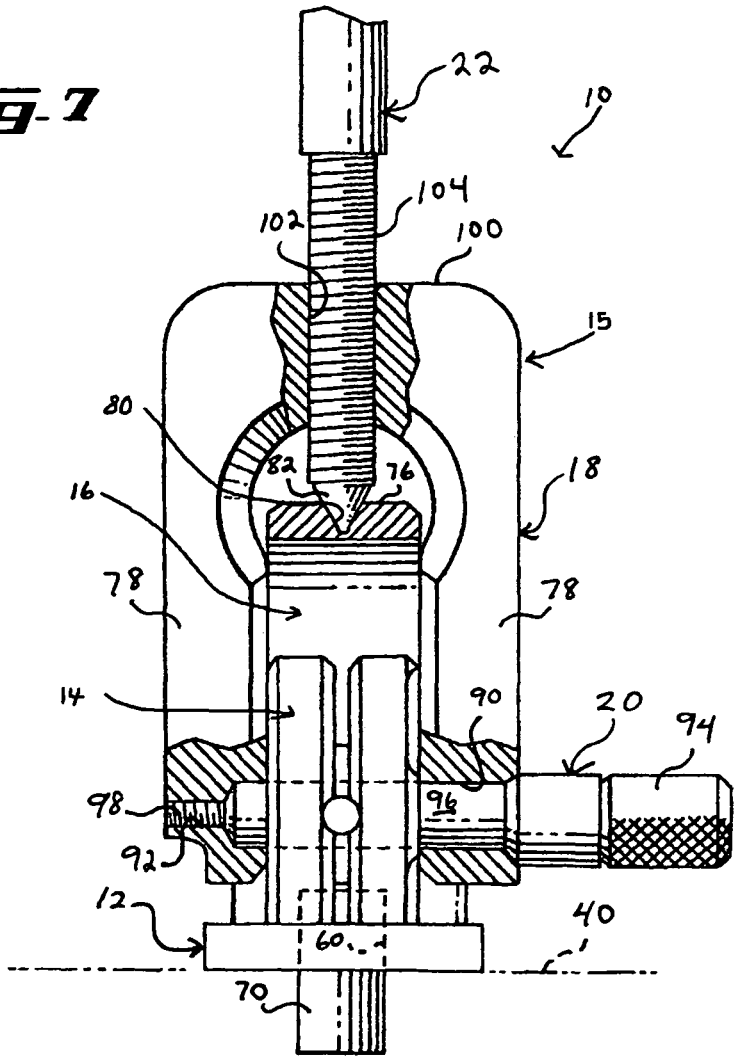
FIG. 7, in a fragmented, side cross-sectional view, illustrates the tool shown in FIG. 1, here shown engaged on a dowel pin that is press mounted into a blind hole of a mounting plate.
Figure 8:
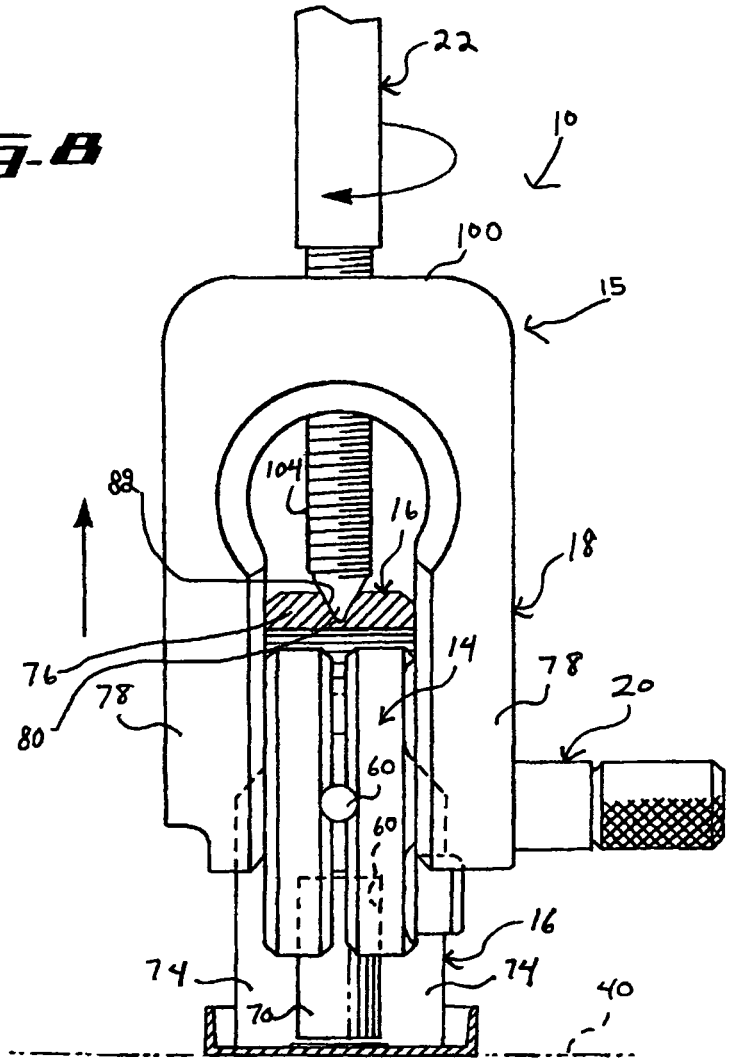
FIG. 8, in a fragmented, side cross-sectional view, illustrates the tool shown in FIGS. 1 and 7, here shown after the dowel pin has been extracted from the mounting plate.

The gripping element mount 15 is configurable between a first configuration, seen in FIG. 7 for example, and a second configuration, seen in FIG. 8 for example. In the first configuration, the pin gripping element 14 is substantially adjacent to the base element 12. In the second configuration, the pin gripping element 14 is further away from the base element 12 than in the first configuration. Typically, the gripping element mount 15 includes an actuator 22 for selectively moving the gripping element mount 15 between the first and second configurations.

In some embodiments of the invention, with the pin gripping element 14 gripping the pin 70 partially inserted in the component bore 72, the gripping element mount 15 exerts a pulling force on the pin 70 that is substantially longitudinally oriented with respect to the pin 70 when the gripping element mount 15 is moved from the first configuration to the second configuration.

FIG. 2 shows an example of a base element 12 represented by a substantially rectangular-shaped plate member that is generally defined as having longitudinal side portions 26, end portions 28, a top surface 30 and an underside surface 32. However, the base element 12 may have any other suitable shape, planar or not, to more easily conform to the shape of the surface of the pin receiving component 40.

As seen for example in FIG. 3, the base element 12 defines a base aperture 34 extending therethrough for allowing access to the pin 70 when the base element 12 abuts against the pin receiving component 40 in register with the component bore 72. For example the base aperture 34 is substantially rectangular and occupies a central position through the base element 12 and extends substantially the width of the base element 12. The centrally provided base aperture 34 is surrounded by the remainder of the base element 12, which thus provides a stable platform to which the other elements of the tool 10 can be mounted. Stability is important in many applications so that relatively large gripping and pulling forces can be exerted on the pin 70 without damaging the pin 70 or the pin receiving component 40.

As best illustrated in FIGS. 2 and 3, the base aperture 34 is tapered in a direction leading toward the underside surface 32 with its inner edge defining an inwardly arched groove.

As best illustrated in FIG. 4, the base aperture 34 is suitably sized and configured for receiving, in a cradle-like configuration, a peripheral portion of the pin gripping element 14. Furthermore, when a peripheral portion of the pin gripping element 14 is positioned therein, the portion of the peripheral surface of the pin gripping element 14 that is closest to the underside surface 32 substantially coincides with the underside surface 32 of the base element 12 such that a portion of the surface of the pin gripping element 14 may abut against the pin mounting component 40.

A pair of elongated recesses 46, extending laterally through the top surface 30 of the base element 12, are provided in a substantially parallel fashion proximal the end portions 28 thereof. The pair of parallel recesses 46 are for engaging correspondingly shaped and configured distal ends of the gripping element mount 15, as described in further details hereinbelow.

Arched shaped grooves 42 are provided into the top surface along the lateral edges of the base aperture 34. The arched shaped grooves 42 are suitably sized and positioned such that they are in register with tightening screws 44 when the pin gripping element 14 is positioned within the base aperture 34, as best illustrated in FIG. 4. The tightening screws 44 are part of the the pin gripping element 14 and are described in further details hereinbelow.

It is to be noted that a pair of arched shaped grooves 42 may be provided along only one, or along both of the longitudinal side portions 26 of the base element 12.

In some embodiments of the invention (not shown in the drawings), the base element 12 is provided with a pair of arched shaped grooves 42 along only one longitudinal side portion 26, with the opposite longitudinal side being relatively thicker for an overall stronger structural integrity of the base element 12, which may be particularly useful when extracting a dowel proximal a corner of the pin receiving component 40.

Figure 5:
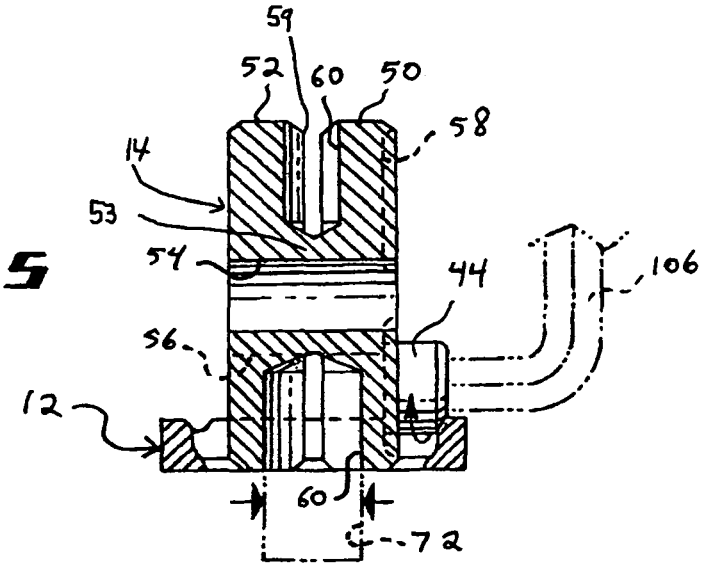
FIG. 5, in a side cross-sectional view taken along section line V-V of FIG. 4, illustrates the pin gripping element shown in FIG. 4.
Figure 6:
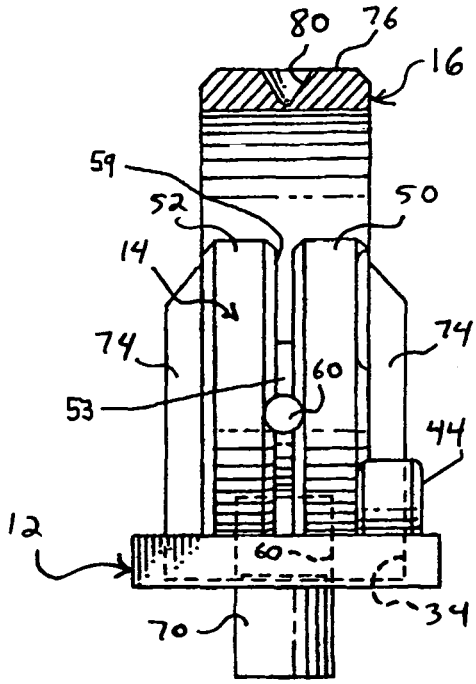
FIG. 6, in a side cross-sectional view, illustrates a first mount component part of a gripping element mount part of the tool shown in FIG. 1, here shown mounted on top of the pin gripping element shown in FIGS. 4 and 5 and of the base element shown in FIGS. 2 and 3.

FIGS. 4, 5 and 6 show various aspects of the pin gripping element 14. Referring for example to FIG. 5, the pin gripping element 14 includes a pair of substantially parallel and spaced apart deformable elements 50 and 52 and a linking element 53 extending therebetween. The deformable elements 50 and 52 define a pin receiving section 60 for receiving the pin 70 between the deformable elements 50 and 52. The pin gripping element 14 also including a deforming element 44 operatively coupled to the deformable elements 50 and 52 for selectively deforming the deformable elements 50 and 52 to move the pin gripping element 14 between the released and gripping configurations. Using a suitable deforming element 44, in the pin gripping configuration, the pin gripping element 14 grips the pin 70 with a predetermined gripping force that depends on the deformation characteristics of the deformable elements 50 and 52 and the configuration and mechanical properties f the deforming element 44.

In the specific embodiment of the invention shown in the drawings, the deformable elements 50 and 52 are substantially planar and substantially disc-shaped and define a gap 59 (better seen in FIG. 6) therebetween. The deformable elements 50 and 52 are disposed parallelly along a common central axis. The linking element 53 is substantially radially centrally located with respect to the deformable elements.

Furthermore, as illustrated in FIG. 5, the pin gripping element 14 is provided with an axially centered bore 54 for freely receiving therethrough, in a snug fit relation, an axle 20.

As best illustrated in FIGS. 4 and 5, the pin gripping element 14 is provided with a plurality, but typically four screw holes 56 extending longitudinally parallelly, relative to the central axis of the pin gripping element 14, through both deformable elements 50, 52, and are equidistantly radially disposed proximal a peripheral portion thereof.

The screw holes 56 through the first deformable element 50 are suitably sized for freely slidably receiving therethrough the distal elongated end of the deforming element 44, which takes the form of a tightening screw 44. The corresponding screw holes 56 through the opposite deformable element 52 are suitably threaded for engaging the threaded end of the tightening screws 44. To ensure a proper grip, in some embodiments of the invention, the tightening screws 44 are screwed using a torque wrench. However, in other embodiments, the tightening screws 44 and the deformable elements 50 and 52 are configured such that hand tightening of the tightening screws 44 provides a predetermined gripping force on the pins 44 that is sufficient to pull the pins 70 out of the component bores 72 while being small enough to prevent damage to the pins 70.

The outer surface of the first deformable element 50 is typically provided with shallow screw head recesses 58 about the outer ends of the screw holes 56. The tightening screws 44 for example have an Allen-key compatible head portion.

The pin gripping element 14 is provided with at least one, but typically more than one pin receiving section 60 taking the form of pin gripping hollows 60 for receiving the pin 70. The pin gripping hollows 60 are each configurable between an expanded configuration and a retracted configuration. The pin gripping hollows 60 are in the expanded configuration when the pin gripping element 14 is in the released configuration and the pin gripping hollows 60 are in the retracted configuration when the pin gripping element 14 is in the gripping configuration. The pin gripping hollows 60 have different diameters to accommodate substantially snugly thereinto pins 70 of different diameters. For example, each of the cylindrical pin gripping hollow 60 has a diameter that substantially correspond to one of the most popular diametrical sizes of dowel pins used in the machining and molding industry.

The pin gripping hollows 60 extend substantially radially inwardly in the pin gripping element 14 and are defined by the deformable elements 50 and 52. The deforming element 44 is operatively coupled to the deformable elements 50 and 52 to selectively narrow the gap 59 at the periphery of the deformable elements 50 and 52 to vary a diameter of the pin gripping hollows 60. To that effect, the pin gripping hollows 60 are circumferentially interrupted to allow variations in their dimensions. It should be noted that the deformation of the deformable elements 50 and 52, and thus the variations in dimensions of the pin gripping hollows 60, are typically relatively small in use, when a pin 70 is inserted in the pin gripping hollows 60. These variations need only to be of a magnitude sufficient for transmitting a gripping force to the pin 70.

Typically, the pin gripping hollows 60 are inwardly radially extending equidistantly between the transversal screw holes 56. The pin gripping hollows 60 are centered between both deformable elements 50, 52 such that oppositely corresponding side portions of the pin gripping hollows 60 extend laterally through a portion of the oppositely facing surfaces of the deformable elements 50, 52.

For examples, FIG. 5 show, in cross-section view, two oppositely disposed pin gripping hollows 60 having substantially different diametrical sizes. FIG. 6 shows a top plan view of one of the pin gripping hollows 60.

The pin gripping hollows 60 are suitably sized and configured for freely slidably receiving therein, in a snug fit relation, the distal end of a pin 70 that is protruding from the pin mounting component 40, as illustrated in FIGS. 3 and 4.

Thus, the pin gripping hollows 60, in cooperative relation with the tightening screws 44 and the slightly spaced deformable elements 50, 52 of the pin gripping element 14 represent an efficient clamping arrangement that may be used to tightly grip a relatively short distal end of a pin 70.

While the pin gripping element 14 has been exemplified as having four cylindrical pin gripping hollows 60 having differently sized diameters, it is to be understood that a relatively larger tool 10 provided with a correspondingly sized pin gripping element 14 may have relatively more pin gripping hollows 60 having correspondingly more differently sized diameters.

Furthermore, while standard diameter sizes of dowel pins may generally range from 0.020 inch to one (1) inch, it is to be understood that the pin gripping hollows 60 may be configured to extract relatively smaller or larger diameter sizes of dowel pins.

As seen for example in FIG. 1, the gripping element mount 15 includes a first mount component 16 mechanically coupled to the base element 12 and a second mount component 18 mechanically coupled to the pin gripping element 14, the first and second mount components 16 and 18 being movable with respect to each other. The actuator 22 is operatively coupled to the first and second mount components 16 and 18 for moving the first and second mount components 16 and 18 with respect to each other to move the gripping element mount 15 between the first and second configurations.

The first mount component 16 extends from the base element 12 and straddles the pin gripping element 14. The second mount component 18 straddles the first mount component 16 and the pin gripping element 14. Typically, the second mount component 18 and the pin gripping element 14 are together substantially freely slidably movable relative to the first mount component. Also, in some embodiments of the invention, the first and second mount components 16 and 18 are both substantially U-shaped and opening toward the base element 12.

With reference to FIG. 8, the first mount component 16 defines a pair of substantially parallel and spaced apart first mount legs 74 (only one of which is seen in FIG. 8) interconnected by a first mount base 76. Similarly, the second mount component 18 defines a pair of substantially parallel and spaced apart second mount legs 78 interconnected by a second mount base 100. The first and second mount bases 76 and 100 are substantially perpendicular to each other. The pin gripping element 14 is freely slidable in the space defined by the first mount legs 74 and the second mount legs 78.

In some embodiments of the invention, to improve the stability of the tool 10, the first mount legs are 74 are slightly wider than the first mount base 76 substantially adjacent the base element 12. Furthermore, the distal tip ends of the first mount legs are 74 are suitably sized and shaped to be in register with and received into the elongated recesses 46 of the base element 12, while the first mount base 76 is suitably dimensioned to be freely slidably received between the second mount legs 78 of the second mount component 18.

The first mount base 76 is provided with a centrally disposed and conically shaped blind hole 80 facing the second mount base 100 and provided for abuttingly receiving therein a correspondingly shaped distal pointed end 82 of the actuator 22, as best illustrated in FIGS. 7 and 8 and explained in further details hereinbelow.

Typically, the length of the first mount legs are 74 is such that when the pin gripping element 14 is positioned therebetween, the distance between the portion of the pin gripping element 14 facing the first mount base 76 and the first mount base 76 is equivalent to the average length portion of a standard dowel pin 70 that is press mounted in a blind hole 72 of a mounting plate 40.

Thus, when the pin gripping element 14 firmly grips the protruding end of a dowel pin 70 press mounted in the mounting plate 40, as illustrated in FIG. 7, the inner space defined by the first mount component 16 provides sufficient space to pull the dowel pin 70 substantially completely out of the blind hole 72 when the pin gripping element 14 is perpendicularly lifted away from the mounting plate 40, as illustrated in FIG. 8.

As best illustrated in FIG. 7, the second mount legs 78 are provided, opposed to the second mount base 100, with a corresponding pair of axially aligned transversal apertures 90 and 92. The first aperture 90 is suitably sized for freely receiving therethrough a central elongated portion of an axle 20, while the second aperture 92 is suitably sized and shaped, as well as being suitably threaded, for engaging therein the threaded distal end of the axle 20.

Thus, apertures 90 and 92 are for rotatably engaging the pin gripping element 14 between the second mount legs 78 using the axle 20 so that the pin gripping element 14 is supported between the second mount legs 78 by an axle 20 extending between the second mount legs 78 in a substantially parallel and spaced apart relationship relative to the second mount base 100. Therefore, the pin gripping element 14 is rotatable about the axle 20, which allows selection of a pin gripping hollow 60 to position facing the pin 70. This rotation also aligns the pulling force exerted in the pin 70 with the longitudinal axis of the pin 70.

Referring to FIG. 7, the axle 20 may be generally represented by a relatively elongated and substantially cylindrical member having a handle portion 94 and an elongated central portion 96 for freely rotatably engaging the centered bore 54 of the pin gripping element 14. The cylindrical central portion 96 is terminated with a relatively smaller threaded distal end portion 98, for engaging the threaded aperture 92 of the second mount component 18.

The second mount base 100 is provided with a centrally disposed threaded hole 102 extending perpendicularly from the outer surface through to the inner surface portion thereof.

The actuator 22, which takes the form of a T-shaped handle bar, includes a threaded rod 104 threaded through the second mount base 100, and more particularly through the threaded screw hole, and abutting against the first mount base 76. As seen in FIG. 1, the actuator also includes a handle 105 for selectively rotating the threaded rod 104 to longitudinally move the threaded rod 104 with respect to the second mount base. The handle takes the form, for example, of a T-shaped member extending axially from the threaded rod 104.

The various components of the tool 10 described above are typically represented by single-piece elements made of a suitably rigid and rust proof material, or materials, such as, for examples, stainless steel, aluminum, a suitable metal alloy, or the likes. The single piece components may be manufactured using a conventional manufacturing process or processes such as machining, injection molding, or a combination of these processes.

In a manner readily apparent to one skilled in the art of extracting dowel pins 70 from the mounting surfaces of tooling plates, injection molds and the likes, a method of using the tool 10 of the present invention is as follows. A user first position the base aperture 34 of the base element 12 substantially centered on a pin 70 to be extracted from the component bore 72.

A correspondingly sized pin gripping hollow 60 of the pin gripping element 14 is then slidably engaged on the protruding end of the pin 70 until the adjacent peripheral portion of the pin gripping element 14 abuts against the surrounding surface of the pin receiving component 40.

Using a suitably sized Allen-key 106, at least two tightening screws 44 are firmly tightened in the pair of adjacent screw holes 56 on each side of the pin 70 thus having a distal end portion thereof engaged in the pin gripping element 14, as best illustrated in FIGS. 1, 4 and 5.

The first mount component 16 is then suitably positioned in a saddle-like configuration on top of the pin gripping element 14 and base element 12, with its first mount legs 74 firmly engaged in the corresponding elongated recesses 46 of the base element 12.

In turn, the second mount component 18 is transversally positioned in a saddle-like configuration on top of the first mount component 16, followed with inserting and screwing firmly in place the threaded distal end of the axle 20 through the thus axially aligned transversal apertures 90, 92 of the second mount component 18, and the centered bore 54 of the second mount component 18.

Finally, the threaded rod 104 of the actuator 22 is screwed in the threaded hole 102 from the top of the second mount component 18 until its pointed distal end 82 is firmly engaged in the conically shaped blind hole 80 on top of the first mount component 16. From then on, the user may continue to turn the actuator 22 to complete the extraction of the pin 70 from the component bore 72.

As is apparent from the above description, as the pointed distal end 82 of the actuator 22 pushes on the first mount base 76, the firmly engaged pin gripping element 14 on the dowel pin 70 is forcibly distanced from the pin receiving component 40, which results in the extraction of the pin 70 from the component bore 72.

Furthermore, it is important to note that the freely rotatable pin gripping element 14, relative to the axle 20, allows a maximum alignment and grip of the pin gripping element 14 on the dowel pin 70 during the extraction process. This maximum alignment and grip of the pin gripping element 14 on the pin 70 also reduces or eliminates oblique forces between the components of the tool 10, which in turn avoids causing damage to the dowel pin 70 and/or the pin gripping element 14.

It is also to be noted that the handle 105 of the actuator 22 may have any other suitably shaped and configured handle bar such as, for example, an L-shaped handle bar or the like. Furthermore, the handle 105 may be replaced, for examples, by a bolt head, a socket engaging means, or equivalent, to allow the use of a rotary power tool, such has a hand operated power drill or the like, for rotatably driving the threaded rod 104.

Figure 9:
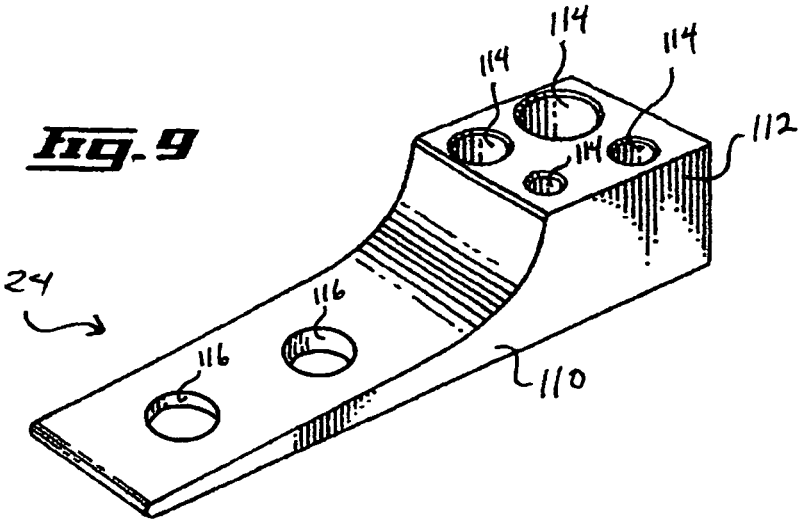
FIG. 9, in a perspective view, illustrates a releaser base usable for helping a user of the tool shown in FIGS. 1, 7 and 8 to loosen a dowel pin engaged in the pin gripping element.
Figure 10:
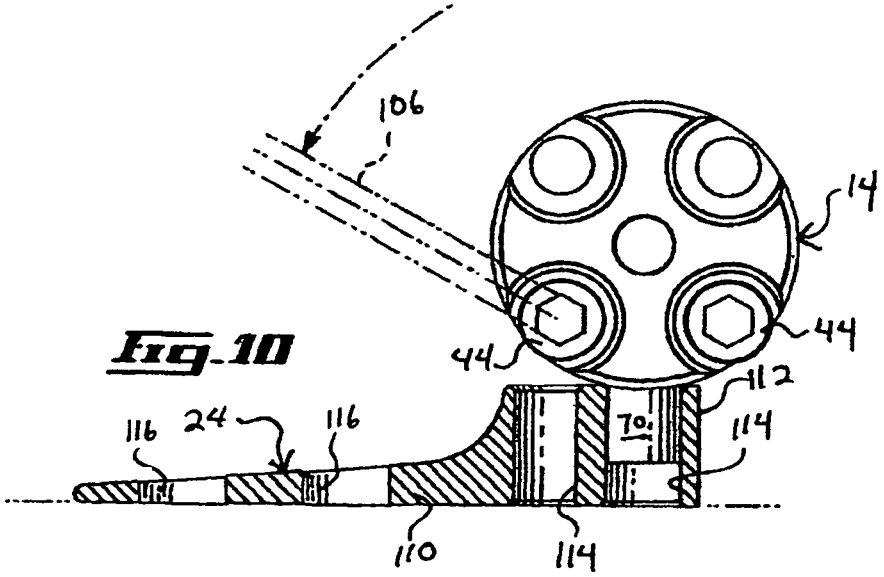
FIG. 10, in a cross-sectional view, illustrates the releaser base shown in FIG. 9, here showing a loosening operation of a dowel pin engaged in the pin gripping element.

In some embodiments of the invention, to loosen and free the pin 70 firmly engaged in one of the pin gripping hollows 60 of the pin gripping element 14, a releaser base 24, such as the one illustrated in FIGS. 9 and 10, may be used.

The releaser base 24 defines an elongated base portion 110 adapted to rest stably on a surface, and a distal end portion 112 that is provided with a plurality of base bores 114 having various diametrical dimensions and a depth that are substantially equivalent in number and size, to the plurality of pin gripping hollows 60 of the pin gripping element 14.

Furthermore, the relatively thin and elongated proximal end portion of the base portion 110 of the releaser base 24 is typically provided with a pair of through holes 116 that are suitably sized and positioned for freely receiving therein the protruding head portions of a pair of tightening screws 44 firmly tightened in two adjacent screw holes 56 in the pin gripping element 14.

FIG. 10 illustrates a mode of usage of the releaser base 24 for releasing a pin 70 tightly gripped in a pin gripping hollow 60 of the pin gripping element 14.

In use, and with the releaser base 24 safely resting on a stable surface, the protruding end of the pin 70 from the pin gripping element 14 is slidably engaged in a correspondingly sized base bore 114 of the releaser base 24.

While holding down with one hand the pin gripping element 14 firmly engaged in the releaser base 24, the user may use a suitable Allen-key 106 to loosen the two tightening screws 44 and free the pin 70 from the pin gripping element 14.

In other instances, where only a pair of tightening screws 44 are firmly tightened in their respective screw holes 56 of the pin gripping element 14, but without a pin 70 present in the pin gripping hollow 60 between the two, such as when an extraction operation has slipped and failed to extract the pin 70, the pair of through holes 116 may be used.

For example, the releaser base 24 may first be positioned longitudinally sideways near the side edge of a stable surface, such as along the edge of a table or the like, and with the substantially planar underside surface of the base substantially aligned with the adjacent side edge of the table.

Next a user holds with one hand the pin gripping element 14 such that the protruding head portions of the pair of tightening screws 44 are firmly engaged in the corresponding through holes 116 along the underside surface of the base. With other hand he is now able to manipulate an Allen-key 106 through the opposite side of the through holes 116 in order to loosen the pair of tightening screws 44.

Likewise the other components of the tool 10, the releaser base 24 may be preferably represented by a single-piece element made of a suitably rigid material.

Although the present invention has been described hereinabove by way of preferred embodiments thereof, it can be modified, without departing from the spirit and nature of the subject invention as defined in the appended claims.

What is claimed is:

1. A tool for extracting a pin inserted in a component bore, said component bore extending into a pin receiving component, said tool comprising:

a pin gripping element, said pin gripping element being configurable between a released configuration in which said pin and said pin gripping element are movable relative to each other and a gripping configuration in which said pin gripping element grips said pin by frictionally engaging said pin so that said pin and said pin gripping element are attached to each other;

a base element for abutting against said pin receiving component when said pin gripping element grips said pin with said pin inserted in said component bore; and a gripping element mount mounting said pin gripping element to said base element, said gripping element mount being configurable between a first configuration and a second configuration, wherein, in said first configuration, said pin gripping element is substantially adjacent to said base element, and in said second configuration, said pin gripping element is further away from said base element than in said first configuration;

said gripping element mount including an actuator for selectively moving said gripping element mount between said first and second configurations.

2. A tool as defined in claim 1, wherein said pin gripping element includes a pin gripping hollow for receiving said pin, said pin gripping hollow being configurable between an expanded configuration and a retracted configuration, said pin gripping hollow being in said expanded configuration when said pin gripping element is in said released configuration and said pin gripping hollow being in said retracted configuration when said pin gripping element is in said gripping configuration.

3. A tool as defined in claim 2, wherein said pin gripping element includes at least two pin gripping hollows each configurable between an expanded configuration and a retracted configuration, said pin gripping hollows being in said expanded configuration when said pin gripping element is in said released configuration and said pin gripping hollows being in said retracted configuration when said pin gripping element is in said gripping configuration, said pin gripping hollows having different diameters.

4. A tool as defined in claim 1, wherein said pin gripping element includes a pair of substantially parallel and spaced apart deformable elements and a linking element extending therebetween, said deformable elements defining a pin receiving section for receiving said pin between said deformable elements, said pin gripping element also including a deforming element operatively coupled to said deformable elements for selectively deforming said deformable elements to move said pin gripping element between said released and gripping configurations.

5. A tool as defined in claim 4, wherein said deformable elements are substantially planar and substantially disc-shaped and define a gap therebetween;

said linking element is substantially radially centrally located with respect to said deformable elements; and said pin receiving section includes a pin gripping hollow extending substantially radially inwardly in said pin gripping element and defined by said deformable elements.

6. A tool as defined in claim 5, wherein said deforming element is operatively coupled to said deformable elements to selectively narrow said gap at a periphery of said deformable elements to vary a diameter of said pin gripping hollow.

7. A tool as defined in claim 1, wherein, with said pin gripping element gripping said pin partially inserted in said component bore, said gripping element mount exerts a pulling force on said pin that is substantially longitudinally oriented with respect to said pin when said gripping element mount is moved from said first configuration to said second configuration.

8. A tool as defined in claim 1, wherein said gripping element mount includes a first mount component mechanically coupled to said base element and a second mount component mechanically coupled to said pin gripping element, said first and second mount components being movable with respect to each other, said actuator being operatively coupled to said first and second mount components for moving said first and second mount components with respect to each other to move said gripping element mount between said first and second configurations.

9. A tool as defined in claim 8, wherein said first mount component extends from said base element and straddles said pin gripping element; and said second mount component straddles said first mount component and said pin gripping element.

10. A tool as defined in claim 9, wherein said first and second mount components are both substantially U-shaped and opening toward said base element.

11. A tool as defined in claim 10, wherein said first mount component defines a pair of substantially parallel and spaced apart first mount legs interconnected by a first mount base, said second mount component defines a pair of substantially parallel and spaced apart second mount legs interconnected by a second mount base, and said first and second mount bases are substantially perpendicular to each other.

12. A tool as defined in claim 11, wherein said pin gripping element is supported between said second mount legs by an axle extending between said second mount legs in a substantially parallel and spaced apart relationship relative to said second mount base.

13. A tool as defined in claim 12, wherein said pin gripping element is rotatable about said axle.

14. A tool as defined in claim 10, wherein said actuator includes a threaded rod threaded through said second mount base and abutting against said first mount base.

15. A tool as defined in claim 14, wherein said actuator includes a handle for selectively rotating said threaded rod to longitudinally move said threaded rod with respect to said second mount base.

16. A tool as defined in claim 9, wherein said second mount component and said pin gripping element are together substantially freely pivotally movable relative to said first mount component.

17. A tool as defined in claim 1, wherein, in said pin gripping configuration, said pin gripping element grips said pin with a predetermined gripping force.

18. A tool as defined in claim 1, wherein said base element defines a base aperture extending therethrough for allowing access to said pin when said base element abuts against said pin receiving component in register with said component bore.

19. A tool as defined in claim 1, wherein said pin gripping element, said base element, said gripping element mount and said actuator are detachable from each other.

20. A tool as defined in claim 1, further comprising a releaser base for freeing said pin from said pin gripping element when said pin has been extracted from said pin receiving component, said releaser base including a base bore for receiving said pin.

21. A tool as defined in claim 1, wherein in said gripping configuration, said pin gripping element grips said pin exclusively by frictionally engaging said pin so that said pin and said pin gripping element are attached to each other.

22. A tool as defined in claim 2, wherein said pin gripping hollow is substantially cylindrical.

23. A tool as defined in claim 2, wherein said pin gripping hollow is of substantially constant transversal cross-sectional configuration longitudinally therealong.

24. A tool as defined in claim 2, wherein said griping hollow is delimited by a substantially smooth gripping hollow peripheral surface, said gripping hollow peripheral surface being devoid of protrusions extending radially inwardly in said gripping hollow.

25. A tool as defined in claim 1, wherein said pin gripping element is configured for gripping a headless pin.

* * * * *